US007722343B2

(12) United States Patent
Hirayama

(10) Patent No.: US 7,722,343 B2
(45) Date of Patent: May 25, 2010

(54) SEALED-TYPE ROTARY COMPRESSOR AND REFRIGERATING CYCLE DEVICE

(75) Inventor: Takuya Hirayama, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 332 days.

(21) Appl. No.: 11/739,865

(22) Filed: Apr. 25, 2007

(65) Prior Publication Data

US 2008/0044305 A1 Feb. 21, 2008

(30) Foreign Application Priority Data

Apr. 26, 2006 (JP) ..... 2006-122483

(51) Int. Cl.
*F01C 21/04* (2006.01)
*F04C 29/02* (2006.01)
*F04C 2/332* (2006.01)

(52) U.S. Cl. ..... 418/63; 418/88; 418/94; 418/248; 418/266; 184/6.16; 184/6.18

(58) Field of Classification Search ..... 418/55.6, 418/63, 88, 94, 248, 266; 184/6.16, 6.18
See application file for complete search history.

(56) References Cited

U.S. PATENT DOCUMENTS 3,687,233 A * 8/1972 Greenwald ..... 184/6.18
4,507,064 A * 3/1985 Kocher et al. ..... 418/63
4,640,669 A * 2/1987 Gannaway ..... 184/6.16
4,834,627 A * 5/1989 Gannaway ..... 184/6.16
4,889,475 A * 12/1989 Gannaway et al. ..... 418/210
4,902,205 A * 2/1990 DaCosta et al. ..... 418/88
4,940,341 A * 7/1990 Schuetz et al. ..... 184/6.18
5,087,170 A * 2/1992 Kousokabe et al. ..... 184/6.16
6,024,548 A * 2/2000 Bushnell ..... 184/6.16
6,607,372 B2 * 8/2003 Fukuoka ..... 418/94
6,631,617 B1 * 10/2003 Dreiman et al. ..... 62/84
6,752,608 B1 * 6/2004 Yap ..... 418/63
2002/0063017 A1 * 5/2002 Paczuski ..... 184/6.16
2003/0015373 A1 * 1/2003 Stones ..... 184/6.18

FOREIGN PATENT DOCUMENTS

JP 05-256283 10/1993
JP 2001323886 11/2001

* cited by examiner

*Primary Examiner*—Thomas E Denion
*Assistant Examiner*—Mary A Davis
(74) *Attorney, Agent, or Firm*—DLA Piper LLP (US)

(57) ABSTRACT

A sealed-type rotary compressor includes a rotary drive unit and a compression mechanism coupled via a rotary shaft pivotally supported by a main bearing and a sub-bearing, and roller bearings. In the compressor, there are provided an oil filler opening which is provided to the rotary shaft along its center axis from one end face and which introduces lubricant of the bottom of an closed case, and oil filler openings, one end of which opens into the oil filler opening and the other end of which opens into the outer circumferential surface of the rotary shaft and which feed lubricant to roller bearings are equipped. The oil filler openings are formed to open towards the direction subject to the load when the roller bearings are subject to a large load.

6 Claims, 9 Drawing Sheets

SEALED-TYPE ROTARY COMPRESSOR AND REFRIGERATING CYCLE DEVICE

CROSS-REFERENCE TO RELATED APPLICATIONS

This application is based upon and claims the benefit of priority from prior Japanese Patent Application No. 2006-122483, filed Apr. 26, 2006, the entire contents of which are incorporated herein by reference.

BACKGROUND OF THE INVENTION

1. Field of the Invention

The present invention relates to a sealed-type rotary compressor and a refrigerating cycle device, and in particular, to a sealed-type rotary compressor and a refrigerating cycle device which can improve reliability by effectively feeding lubricant to a roller bearing provided at a rotary sliding portion with a rotary shaft.

2. Description of the Related Art

Conventionally, there is known a sealed-type rotary compressor with a roller bearing provided at the rotary sliding portion of, for example, between a main bearing and a main shaft portion of a rotary shaft, between a sub-shaft and a sub-baring portion of the rotary shaft, and between a roller which eccentrically rotates in a cylinder chamber of the compressor mechanism and a crank shaft portion of the rotary shaft (for example, see Jpn. Pat. Appln. KOKAI Publication Nos. 5-256283 and 2001-323886). By installing a roller bearing at the rotary sliding portion of the compressor, sliding resistance can be reduced and the coefficient of performance can be improved.

The above-mentioned sealed-type rotary compressor has had a following problem. That is, in order to improve the reliability of the rotary sliding portion, sufficient lubrication is required even for roller bearings but lubricant is not sufficiently fed to the roller bearing.

BRIEF SUMMARY OF THE INVENTION

It is an object of the present invention to provide a sealed-type rotary compressor and a refrigerating cycle device which effectively feed lubricant to the roller bearing unit and can improve the reliability even when a roller bearing is provided to the rotary sliding portion.

To achieve the above object, the sealed-type rotary compressor and the refrigerating cycle device according to the present invention are configured as follows:

(1) A sealed-type rotary compressor is characterized by comprising: a sealed casing which stores lubricant on the bottom thereof; an electric motor unit which is housed in this sealed casing; a compression mechanism which is housed in the sealed casing, and has a cylinder that forms a cylinder chamber, a roller that eccentrically rotates in the cylinder chamber, and a vane that, makes reciprocating motion as the roller rotates; a rotary shaft which is pivotally supported by a main bearing and a sub-bearing and couples the electric motor unit and the compressor mechanism; a roller bearing provided in at least one position of between the main bearing and the rotary shaft, between the sub-bearing and the rotary shaft, and between the roller and the crank shaft unit of the rotary shaft; an oil filler opening which is provided to the rotary shaft along the center axis from one end face thereof and introduces lubricant on the bottom inside the sealed casing to the other end face side; and an oil filler opening, one end of which opens to the oil filler opening and the other end of which opens to the outer circumferential surface of the rotary shaft and opens towards the direction subject to a load when the roller bearing is subject to the large load, and which feeds lubricant to the roller bearing.

(2) A refrigerating cycle device is characterized by comprising the sealed-type rotary compressor, a condenser, an expansion device, and an evaporator.

According to the present invention, even when a roller bearing is provided to the rotary sliding unit, lubricant can be effectively fed to the roller bearing unit and the reliability can be improved.

Additional objects and advantages of the invention will be set forth in the description which follows, and in part will be obvious from the description, or may be learned by practice of the invention. The objects and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
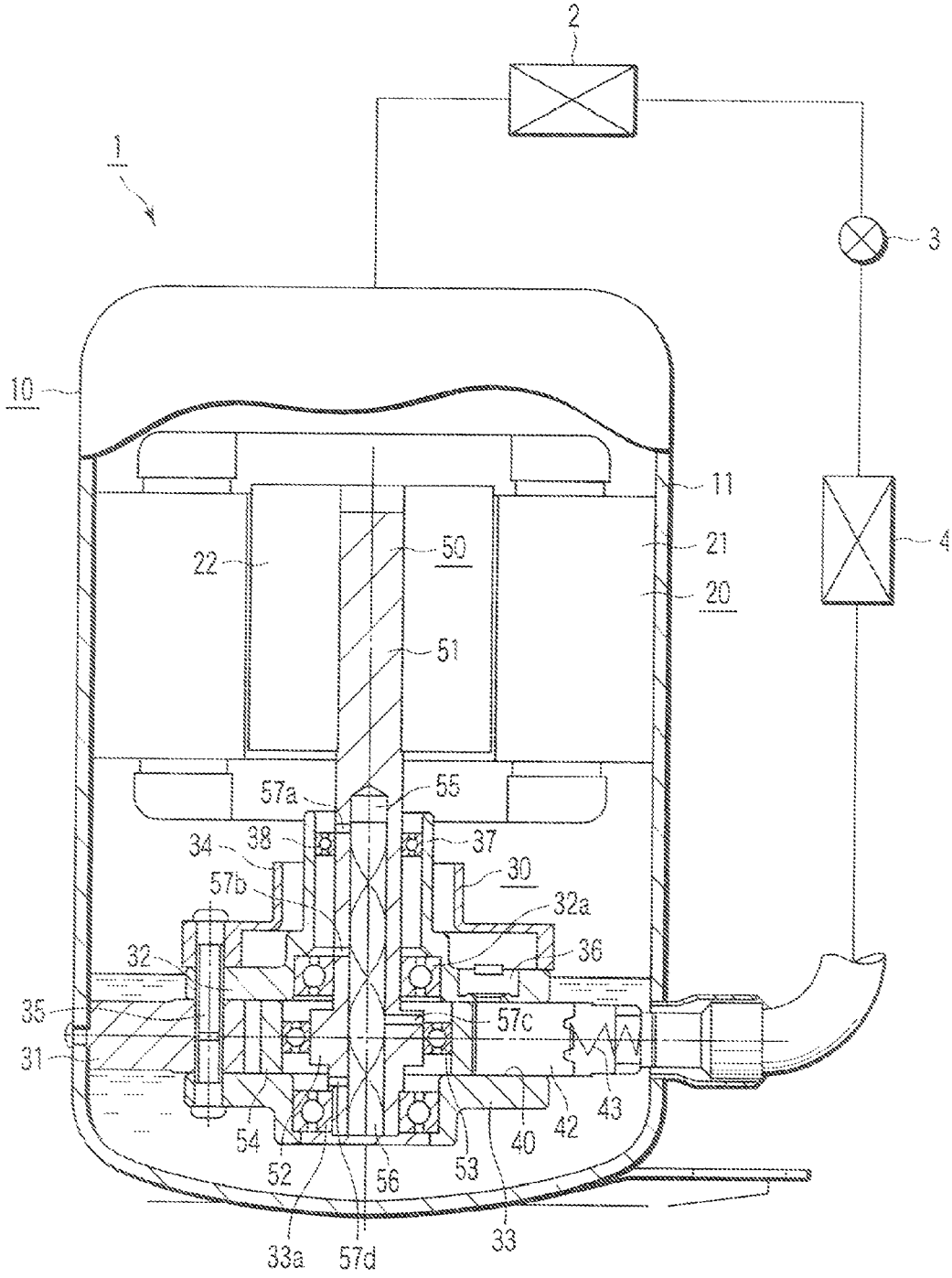
FIG. 1 is a vertical cross-sectional view of a sealed-type rotary compressor according to a first embodiment of the present invention.

FIG. 1 is a vertical cross-sectional view of a refrigerating cycle device 1 according to a first embodiment of the present invention and a sealed-type rotary compressor 10 which is assembled in refrigerating cycle device 1, FIGS. 2 to 5 are cross-sectional views showing the positional relation between compression load and an oil filler opening in a roller bearing assembled in the sealed-type rotary compressor according to the present invention, and FIGS. 6 to 9 are cross-sectional views showing the positional relation between the compression load and the oil filler opening in the roller bearing assembled in the sealed-type rotary compressor.

The refrigerating cycle device 1 is equipped with a condenser 2 that condenses refrigerant, an expansion device 3 connected to this condenser 2, an evaporator 4 that is connected to this expansion device 3 and evaporates the refrigerant, and the sealed-type rotary compressor 10 connected to the outlet side of this evaporator 4.

The sealed-type rotary compressor 10 is a single-type rolling-piston compressor and has a sealed casing 11. In the sealed casing 11, a rotary drive unit 20 provided on the upper side and a compression mechanism 30 provided on the lower side are housed, and the rotary drive unit 20 and the compression mechanism 30 are linked via a rotary shaft 50. The sealed-type rotary compressor 10 is a vertically-provided type in which the rotary shaft 50 is provided along the vertical direction.

The rotary drive unit 20 has, for example, a brushless DC motor used, and is equipped with a stator 21 fixed into the inner surface of the sealed casing 11 and a rotor 22 which is arranged on the inner side of this stator 21 with a predetermined gap and fitted to the rotary shaft 50. The rotary drive unit 20 is connected to an external power supply unit (not illustrated) to receive electric power supply.

The compression mechanism is equipped with a cylinder 31, and a main bearing 32 and a sub-bearing 33 which grasp this cylinder 31 therebetween, and is screwed down with a bolt 35 together with a valve cover 34 provided on the main bearing side 32. A discharge valve 36 is provided to the main bearing 32.

The main bearing 32 and the sub-bearing 33 support the rotary shaft 50 by roller bearings 32*a*, 33*a*, respectively.

A cylindrical extension unit 37 is provided to the main bearing 32, and a roller bearing 38 is provided between the extension unit 37 and the rotary shaft 50. A cylinder chamber 40 and a vane groove 41 (see FIG. 2) which communicates with this cylinder chamber 40 are provided to the cylinder 31. A vane 42 is housed in the vane groove 41 free to extrude and intrude with respect to the cylinder chamber 40, and is energized toward the cylinder chamber 40 by a coil spring 43. In the cylinder 31, a roller 54 later discussed is eccentrically arranged, and by bringing the head end part of the vane 42 into contact with the outer circumferential surface of this roller 54, the cylinder chamber is divided into a suction chamber V side and a compression chamber C side.

The rotary shaft 50 has a columnar shaft main body 51, a crankshaft unit 52 provided at the position corresponding to the cylinder chamber 40 of the shaft main body 51, and a roller 54 fitted to the outer circumference of this crankshaft unit 52 via a roller bearing 53.

An oil filler opening 55 for feeding lubricant to roller bearings 32*a*, 33*a*, 38, and 53 as well as seal units and the like are provided at the center of the rotary shaft 50, and an impeller pump 56 for pumping up lubricant is inserted in the oil filler opening 55. Oil filler openings 57*a* through 57*d* are provided from the oil filler opening 55 to the outer circumferential surface. The oil filler openings 57*a* through 57*d* have one end open to the oil filler opening 55 and the other end open to the outer circumference of the rotary shaft 50. Consequently, the lubricant pumped up inside the oil filler opening 55 with rotation of the rotary shaft 50 is fed to each of the roller bearings 32*a*, 33*a*, 38, and 53 by the oil filler openings 57*a* though 57*d*.

In the refrigerating cycle device 1 configured in this way, the following operation takes place. That is, electric power is fed to the rotary drive unit 20, the rotary shaft 50 is rotatably driven, and the compression mechanism 30 is driven.

In the compression mechanism 30, the roller 54 makes eccentric rotation inside the cylinder chamber 40. Because the vane 42 is constantly elastically pressure-energized by the coil spring 43, the head end edge of the vane 42 slidably contacts with a circumferential wall of the roller 54 and divides the cylinder chamber 40 into the suction chamber V and the compression chamber C. When the inner circumferential surface rotary contact position of the roller 54 with the cylinder chamber 40 coincides with the vane groove 41 and the vane 42 is in the most retracted state, the space volume of this cylinder chamber 40 is maximized. The refrigerant gas is drawn into the cylinder chamber 40 and fills the chamber.

As the roller 54 eccentrically rotates, the rotary contact position of the roller 54 with respect to the inner circumferential surface of the cylinder chamber 40 moves and the volume of the compartmented compression chamber C in the cylinder chamber 40 decreases. That is, the refrigerant gas guided to the cylinder chamber 40 in advance is gradually compressed. The rotary shaft 50 is continuously rotated and the volume of the compression chamber C in the cylinder chamber 40 further decreases to compress the refrigerant gas, and when the pressure rises to a predetermined pressure, the discharge valve 36 opens. High-pressure gas is discharged into the sealed casing 11 via the valve cover 34 and fills the casing. Then, the high-pressure gas is discharged from the sealed casing 11.

The high-pressure gas discharged from the sealed casing 11 is guided to the condenser 2, condenses and liquefies, adiabatically expands by means of the expansion device 3, deprives heat-exchanged air of evaporation latent heat at the evaporator 4 and exerts cooling effect. Then, the refrigerant after evaporated is drawn into the cylinder chamber 40 and circulates in the above-mentioned route.

FIGS. 2 to 5 are cross-sectional views showing positional relationship between the compression load and the oil filler opening 57*c* in the roller bearing 53 assembled in the sealed-type rotary compressor 10.

In the sealed-type rotary compressor, in general, it is when the eccentric direction of the crankshaft unit 52 rotates about 180 degrees with the position on the vane 42 side used as the reference position (0 degrees) that the pressure of the compression chamber C reaches the discharge pressure, although this slightly differs depending on compressor operating conditions, etc.

Loads caused by a pressure difference between the pressure of the compression chamber C and the pressure of the suction chamber V are applied to the roller bearing 53. That is, by the pressure difference, the roller 54 is pressed from the compression chamber C side to the suction chamber V side, and the force acts on the roller bearing 53.

The force F caused by the differential pressure is expressed by:

$$F=Pc\cdot Ac-Ps\cdot As \quad (1)$$

where Pc denotes pressure of the compression chamber C, Ac surface area of the roller 54 facing the compression chamber C, Ps pressure of the suction chamber V, and As surface area of the roller 54 facing the suction chamber V.

It is when the pressure of the compression chamber C is the discharge pressure that the differential pressure is maximized, and it is when the eccentric direction of the crankshaft unit 52 rotates about 180 degrees from the reference position that the surface area of the roller 54 facing the compression chamber C is maximized while the pressure of the compression chamber C is the discharge pressure. Consequently, it is when the eccentric direction of the crankshaft unit 52 is located at the position 180 degrees from the reference position that the roller bearing 53 is subject to the greatest load (FIG. 4), and the position is the portion facing the compression chamber C side as shown by the chain double-dashed line Q in FIG. 4, that is, within the range of about 210 to 330 degrees when the eccentric direction of the crankshaft unit 52 rotates 180 degrees from the reference position.

Figure 2:
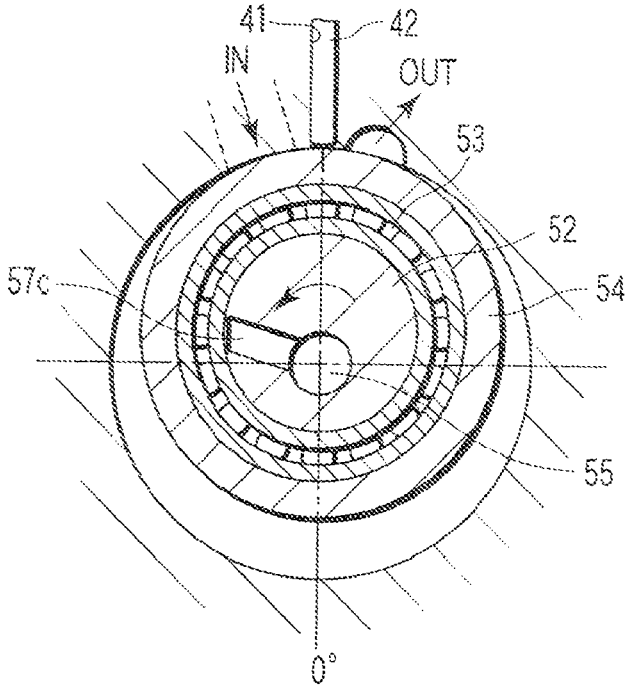
FIG. 2 is a cross-sectional view showing the positional relation between compression load and an oil filler opening in a roller bearing assembled in the sealed-type rotary compressor of the present invention.
Figure 3:
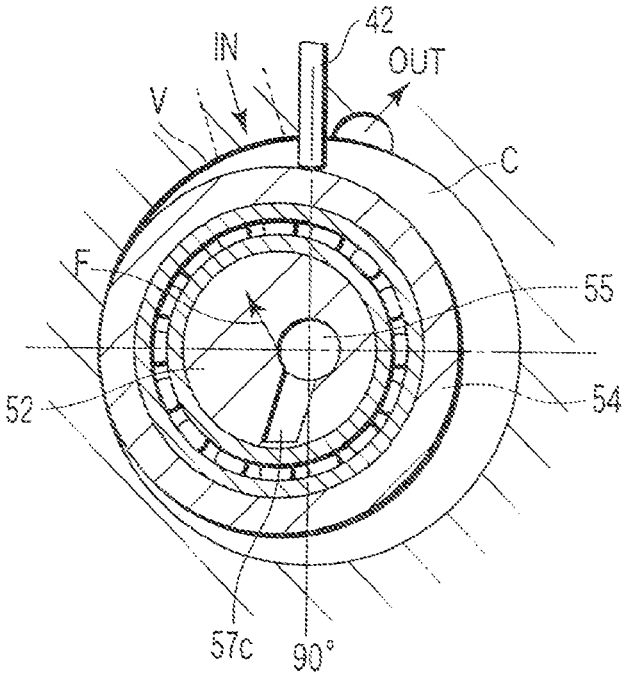
FIG. 3 is a cross-sectional view showing the positional relation between the compression load and the oil filler opening in the roller bearing.
Figure 4:
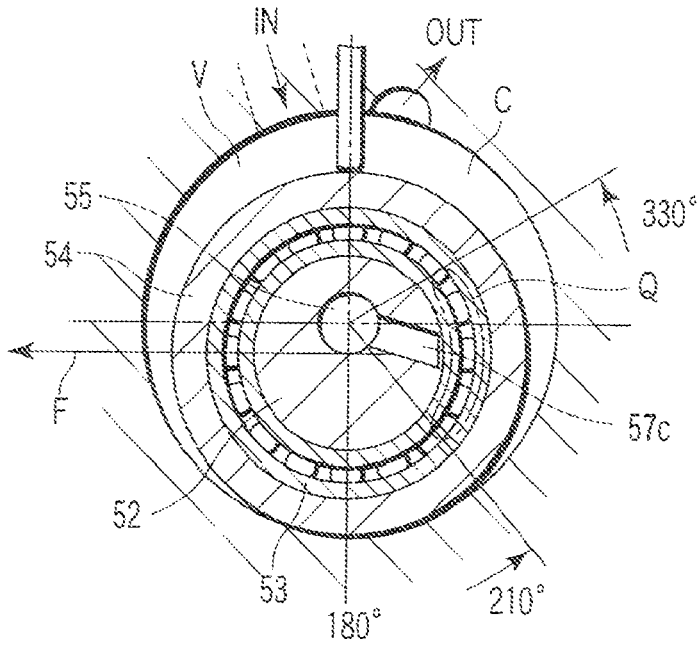
FIG. 4 is a cross-sectional view showing the positional relation between the compression load and the oil filler opening in the roller bearing.
Figure 5:
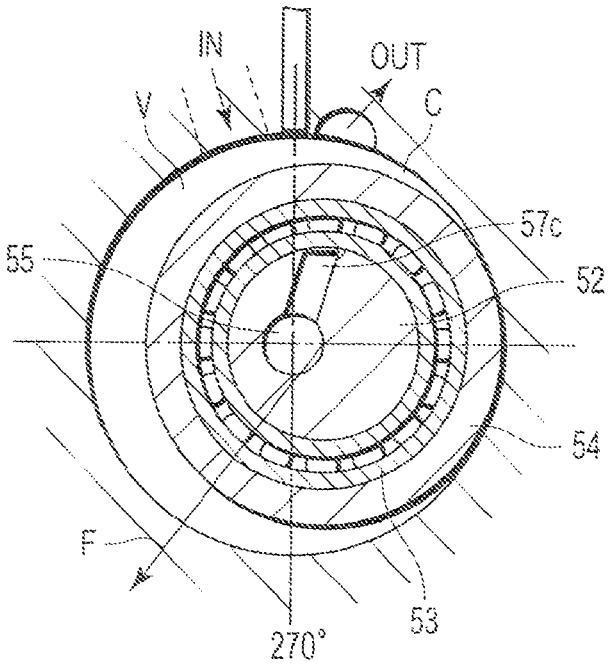
FIG. 5 is a cross-sectional view showing the positional relation between the compression load and the oil filler opening in the roller bearing.

Consequently, forming the oil filler opening 57*c* at the position shown in FIG. 2 makes it possible to feed lubricant at a proper timing and to a proper position.

Note that the outlet of the oil filler opening 57*c* is open on the upper side of the roller bearing 53. Consequently, fresh lubricant can be fed more reliably to the portion subject to the largest load of the roller bearing 53 by gravity.

FIGS. 6 to 9 are cross-sectional views showing the positional relationship between the compression loads and the oil filler openings 57*a*, 57*b*, and 57*d* at the roller bearings 32*a*, 33*a*, and 38 assembled in the sealed-type rotary compressor 10.

Loads caused by pressure difference between the pressure of the compression chamber C and the pressure of the suction chamber V are applied to the roller bearings 32*a*, 33*a*, and 38, as is the case with the roller bearing 53. That is, by the pressure difference, the rotary shaft 50 is strongly pressed against the roller bearings 32*a*, 33*a*, and 38. The timing at which the roller bearings 32*a*, 33*a*, and 38 are subject to the greatest loads is the same as that of the roller bearing 53, but the position is the position deviated by 180 degrees from the case of the roller bearing 53, that is, the range from about 30 to 150 degrees when the eccentric direction of the crankshaft unit 52 rotates 180 degrees from the reference position.

Figure 6:
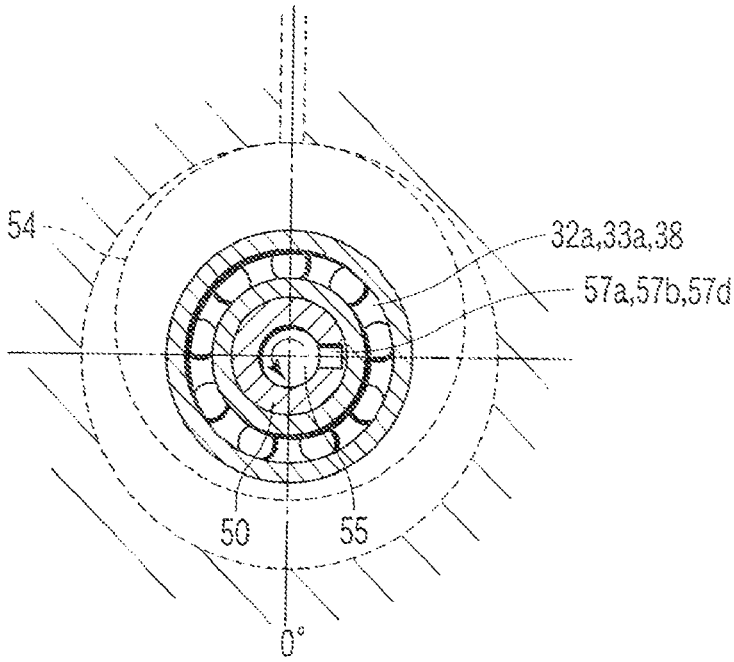
FIG. 6 is a cross-sectional view showing the positional relation between the compression load and the oil filler opening in the roller bearing assembled in the sealed-type rotary compressor.
Figure 7:
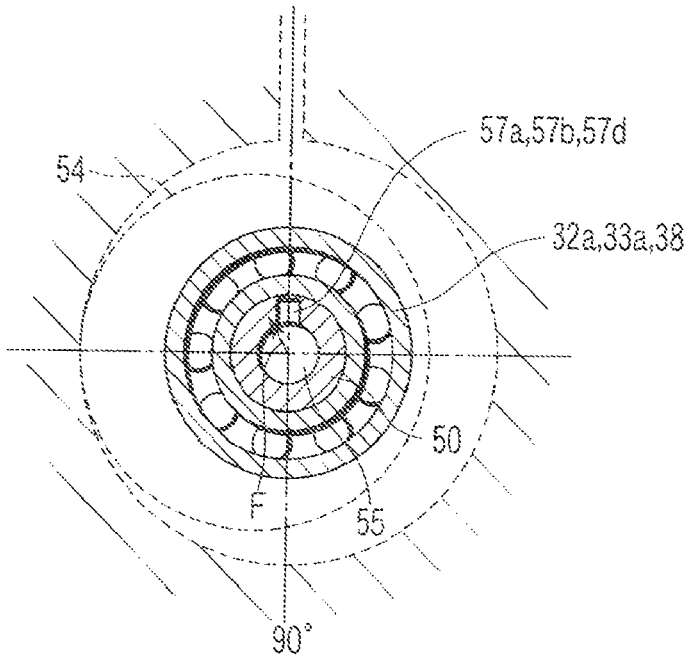
FIG. 7 is a cross-sectional view showing the positional relation between the compression load and the oil filler opening in the roller bearing.
Figure 8:
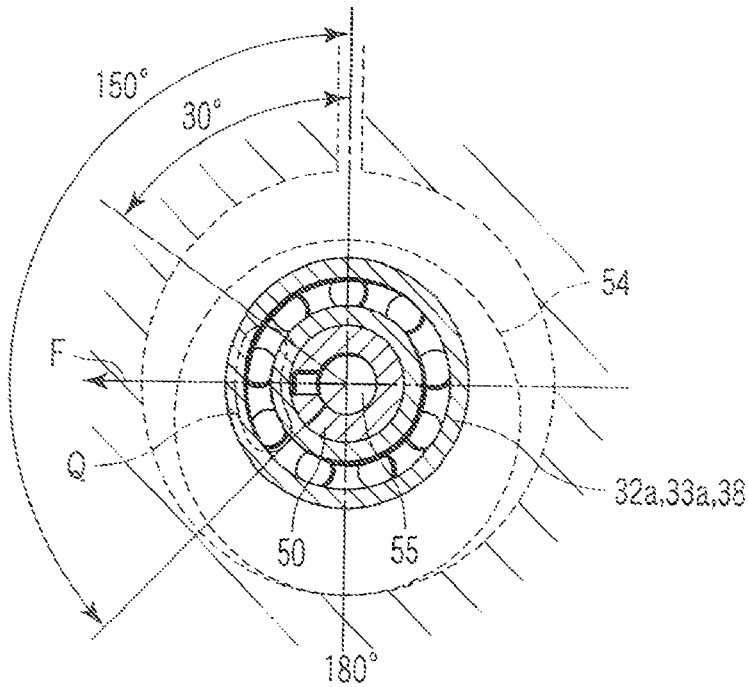
FIG. 8 is a cross-sectional view showing the positional relation between the compression load and the oil filler opening in the roller bearing.
Figure 9:
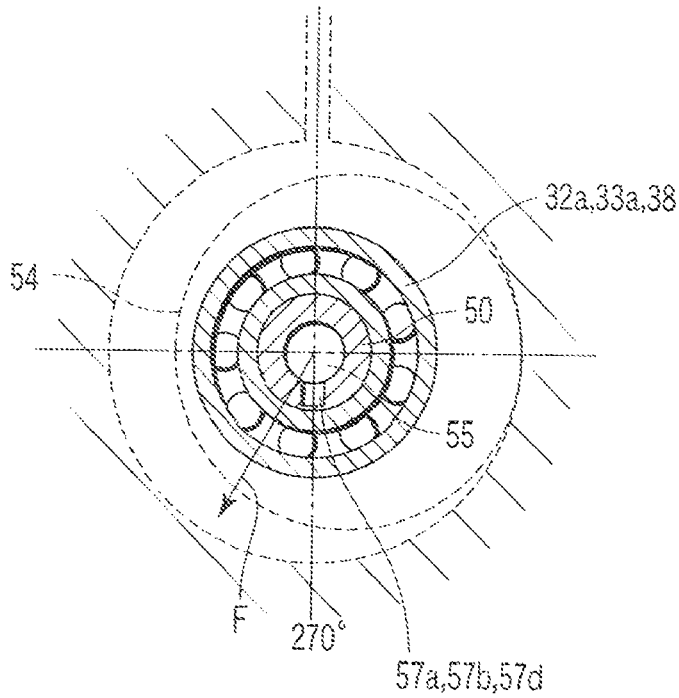
FIG. 9 is a cross-sectional, view showing the positional relation between the compression load and the oil filler opening in the roller bearing.

Consequently, forming the oil filler openings 57*a*, 57*b*, and 57*d* at the positions shown in FIG. 6 makes it possible to feed lubricant at a proper timing and to a proper position.

Note that the outlets of the oil filler openings 57*a*, 57*b*, and bid are open on the upper side of the roller bearings 32*a*, 33*a*, and 38. Consequently, fresh lubricant can be fed more reliably to the portion subject to the largest load of the roller bearings 32*a*, 33*a*, and 38 by gravity.

According to the sealed-type rotary compressor 10 configured in this way, fresh lubricant can be reliably fed to the portion of the roller bearing subject to the greatest load, and thus it is possible to provide a highly reliable compressor.

Figure 10:
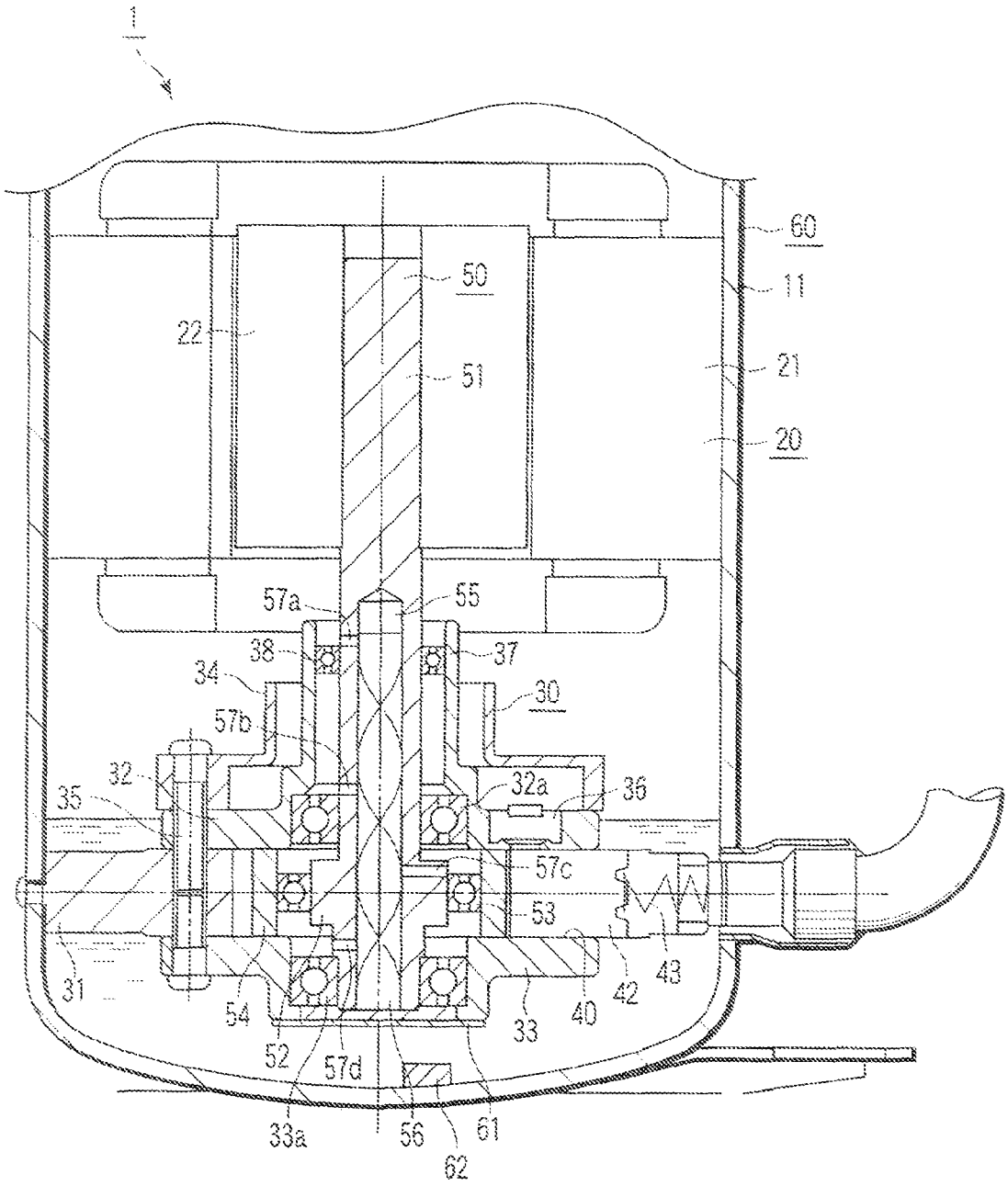
FIG. 10 is a vertical cross-sectional view of a sealed-type rotary compressor according to a second embodiment of the present invention.

FIG. 10 is a vertical cross-sectional view showing a sealed-type rotary compressor 60 according to a second embodiment of the present invention. In FIG. 10, the same characters designate the same functional parts of FIG. 1 and detailed description thereof will be omitted.

In the sealed-type rotary compressor 60, a filter 61 is provided to the opening of the sub-bearing 33 facing the inlet of the oil filler opening 55 at the shaft center of the rotary shaft 50. In addition, a permanent magnet 62 is mounted on the bottom surface of the sealed casing 11 and facing the opening of the sub-bearing 33.

According to the sealed-type rotary compressor 60 configured in this way, by the filter 61 and the permanent magnet 62 provided, it is possible to prevent lubricant with abrasion powder and other iron-based foreign matters from being taken up to the oil filler opening 55 of the rotary shaft 50, and still cleaner lubricant can be fed to each of the roller bearings 32*a*, 33*a*, 38, and 53.

Consequently, according to the sealed-type rotary compressor 60 according to the second embodiment, a highly reliable compressor can be provided.

Figure 11:
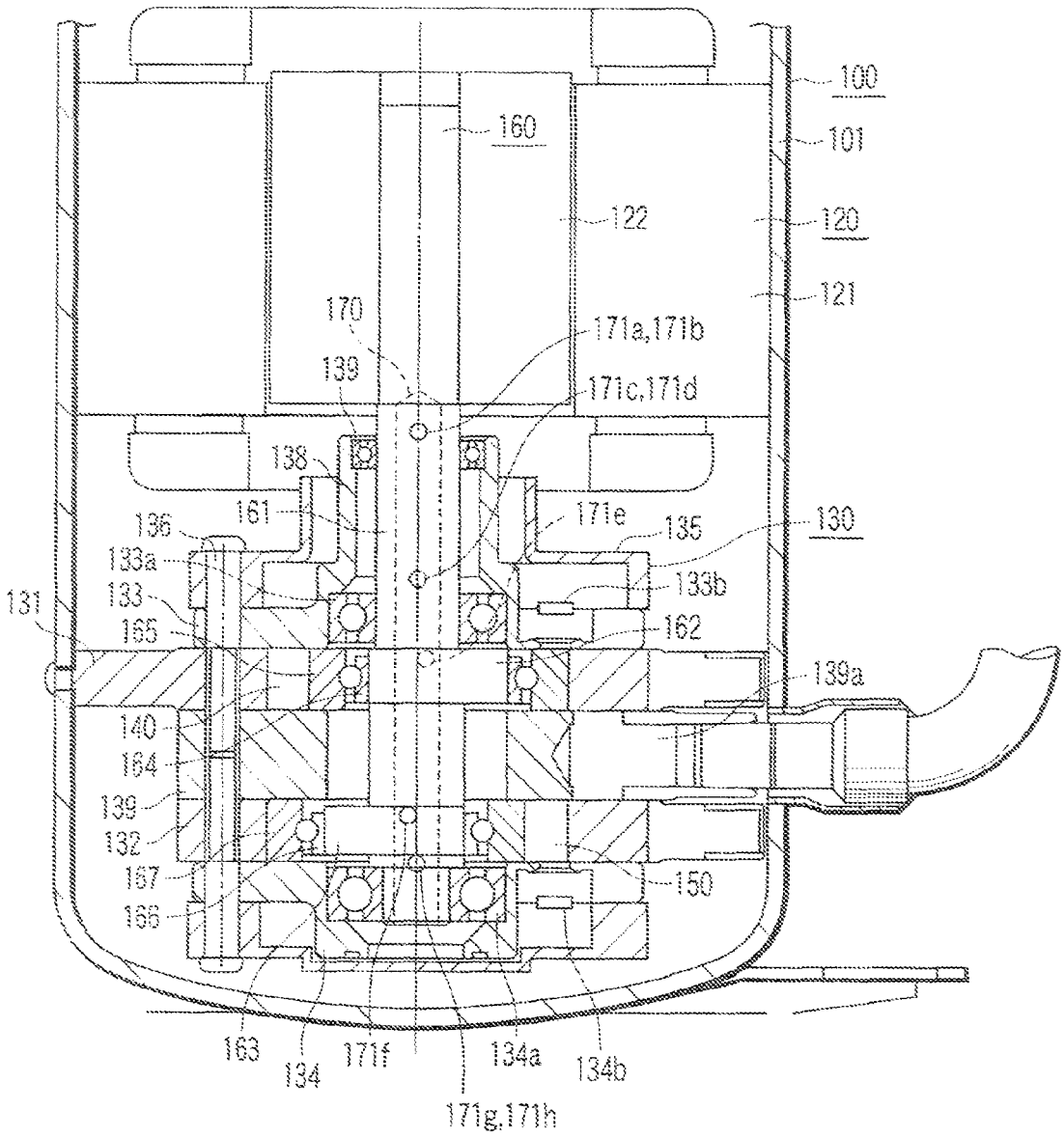
FIG. 11 is a vertical cross-sectional view of a sealed-type rotary compressor according to a third embodiment, of the present invention.
Figure 12:
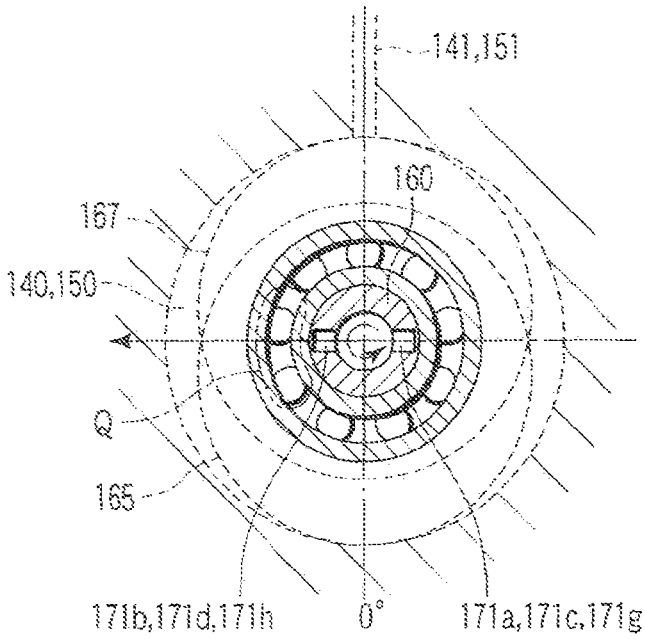
FIG. 12 is a cross-sectional view showing the positional relation between compression load and an oil filler opening in a roller bearing assembled in the sealed-type rotary compressor.
Figure 13:
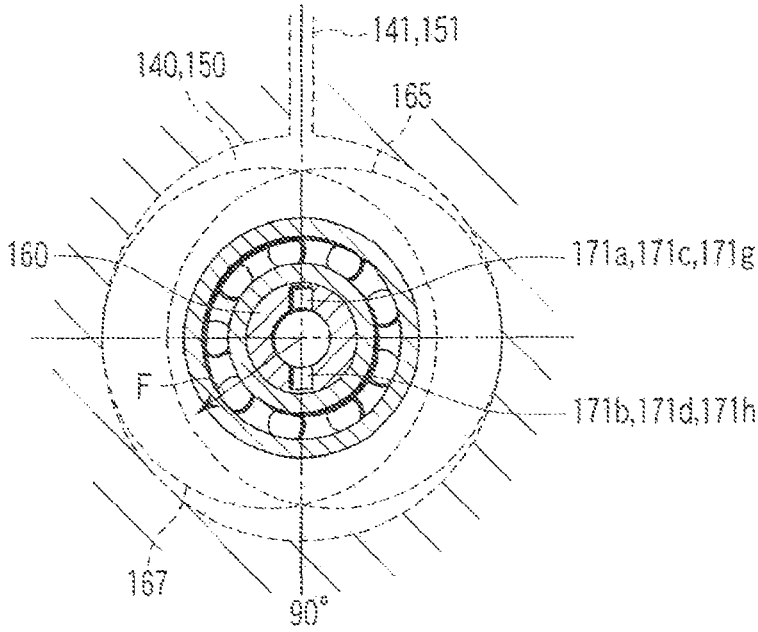
FIG. 13 is a cross-sectional view showing the positional relation between the compression load and the oil filler opening in the roller bearing
Figure 14:
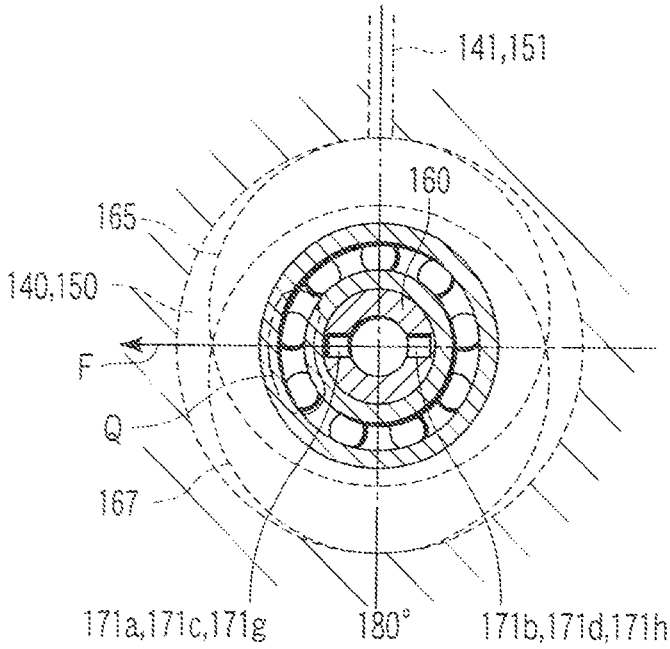
FIG. 14 is a cross-sectional view showing the positional relation between the compression load and the oil filler opening in the roller bearing.
Figure 15:
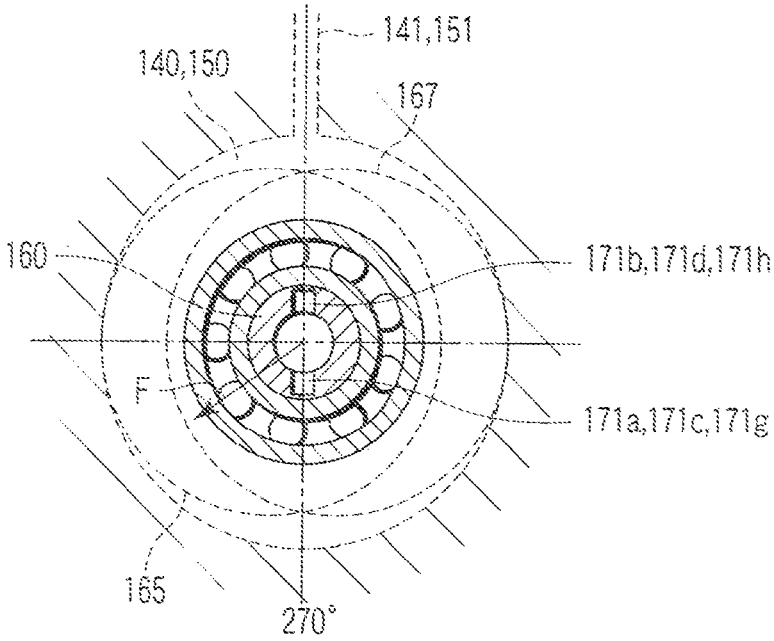
FIG. 15 is a cross-sectional view showing the positional relation between the compression load and the oil filler opening in the roller bearing.

FIG. 11 is a vertical cross-sectional view of a sealed-type rotary compressor 100 according to a third embodiment of the present invention, and FIGS. 12 to 15 are cross-sectional views showing the positional relation between compression load and oil filler openings 171*a* through 171*h* in roller bearings 133*a*, 134*a*, 139, 164, and 166 assembled in the sealed-type rotary compressor 100.

The sealed-type rotary compressor 100 is a twin-type rolling-piston compressor and is equipped with a sealed casing 101. In the sealed casing 101, a rotary drive unit 120 provided on the upper side and a compression mechanism 130 provided on the lower side are housed, and the rotary drive unit 120 and the compression mechanism 130 are linked via a rotary shaft 160.

The rotary drive unit 120 has, for example, a brushless DC motor used, and is equipped with a stator 121 fixed into the inner surface of the sealed casing 101 and a rotor 122 which is arranged on the inner side of this stator 121 with a predetermined gap and fitted to the rotary shaft 160. The rotary drive unit 120 is connected to an external power supply unit (not illustrated) to receive electric power supply.

The compression mechanism 130 is equipped with a first cylinder 131 and a second cylinder 132, and an intermediate partition board 139 held between these first cylinder 131 and the second cylinder 132. The refrigerant is taken up from a suction passage 139*a* formed in the intermediate partition board 139 into the first cylinder 131 and the second cylinder 132.

Furthermore, the first cylinder 131 and the second cylinder 132 are held between a main-bearing 133 and a sub-bearing 134 and is screwed down with a bolt 136 together with a valve cover 135 provided on the main bearing 133 side.

The main bearing 133 and the sub-bearing 134 support the rotary shaft 160 by roller bearings 133*a* and 134*a*, respectively. A discharge valve 133*b* is provided to the main bearing 133, and a discharge valve 134*b* is provided to the sub-bearing 134.

A cylindrical extension unit 138 is provided to the main bearing 133, and a roller bearing 139 is provided between the extension unit 138 and the rotary shaft 160. A first cylinder chamber 140 and a vane groove 141 (see FIG. 12) which communicates with this cylinder chamber 140 are provided to the first cylinder 131. A vane (not illustrated) is housed in the vane groove 141 free to extrude and intrude with respect to the first cylinder chamber 140, and is energized to the first cylinder chamber 140 side by a coil spring (not illustrated). A roller 165 later discussed is eccentrically arranged in the first cylinder 131, and by bringing the head end part of the vane into contact with the outer circumferential surface of this roller 165, the cylinder chamber is divided into a suction chamber V and a compression chamber C.

A second cylinder chamber 150 and a vane groove 151 (see FIG. 12) which communicates with this second cylinder chamber 150 are provided to the second cylinder 132. A vane (not illustrated) is housed in the vane groove 151 free to extrude and intrude with respect to the second cylinder chamber 150, and is energized to the second cylinder chamber 150 side by a coil spring (not illustrated). A roller 167 later discussed is eccentrically arranged in the second cylinder 132, and by bringing the head end part of the vane into contact with the outer circumferential surface of this roller 167, the cylinder chamber is divided into a suction chamber V and a compression chamber C.

The rotary shaft 160 has a columnar shaft main body 161, a first crankshaft unit 162 provided at the position corresponding to the first cylinder chamber 140 and a second crankshaft unit 163 provided at the position corresponding to the second cylinder chamber 150 of the shaft main body 161. The eccentric directions of the first crankshaft unit 162 and the second crankshaft unit 163 differ by 180 degrees from each other.

The roller 165 is integrally formed via the roller bearing 164 on the outer circumference of the first crankshaft unit 162, and the roller 167 is integrally formed via the roller bearing 166 on the outer circumference of the second crankshaft unit 163.

Note that, in the present embodiment, the roller 165 and the outer race of the roller bearing 164 as well as the roller 167 and the outer race of the roller bearing 166 are integrally formed to achieve reduction of the number of components and the number of assembling man-hours as well as reduction of the compressor size, but as is the case with the sealed-type rotary compressor 10, they may be formed separately.

An oil filler opening 170 for feeding lubricant to roller bearings 133*a*, 134*a*, 139, 164, and 166 as well as seal units and the like is provided at the center of the rotary shaft 160, and an impeller pump (not illustrated) for pumping up lubricant is inserted in the oil filler opening 170. Oil filler openings 171*a* through 171*h* are provided from the oil filler opening 170 to the outer circumferential surface. The oil filler openings 171*a* through 171*h* have one end open to the oil filler opening 170 and the other end open to the outer circumference of the rotary shaft 160. Consequently, the lubricant pumped up inside the oil filler opening 170 with rotation of the rotary shaft 160 is fed to each of the roller bearings 133*a*, 134*a*, 139, 164, and 166 by the oil filler openings 171*a* though 171*n*.

The sealed-type rotary compressor 100 according to the third embodiment is also rotatably driven in the same manner as the above-mentioned sealed-type rotary compressor 10 and the refrigerating cycle device 1 also functions in the same manner.

Next discussion will be made on the location in which the oil filler openings 171*a* through 171*h* are provided. It is preferable to install the outlets of the oil filler openings 171*a* through 171*h* to the vicinity of the portion in which the roller bearings 133*a*, 134*a*, 139, 164, and 166 are subject to the greatest load, in the sealed-type rotary compressor 100 as well. In particular, there are two compressors in the twin type, and thus the rotary shaft 160 is subject to two load peaks in one rotation.

The location of the oil filler opening 171*e* which supplies lubricant to the roller bearing 164 and the location of the oil filler opening 171*f* which feeds lubricant to the roller bearing 166 are decided in accordance with the same principle as that shown in FIGS. 2 to 5. Because the eccentric directions of the first crankshaft unit 162 and the second crankshaft unit 163 differ by 180 degrees from each other, the locations of the oil filler opening 171*e* and the oil filler opening 171*f* differ by 180 degrees from each other.

On the other hand, because the eccentric directions of the first crankshaft unit 162 and the second crankshaft unit 163 differ by 180 degrees from each other, the roller bearings 133*a*, 134*a* and 139 have two timings in which the load increases. That is, when the oil filler openings are rotated by 180 degrees with the eccentric directions of the first crankshaft unit 162 and the second crankshaft unit 163 located in the vane direction, respectively, set as a reference, they must be located in the range of about 30 to 150 degrees.

Consequently, on the rotary shaft 160, two each of oil filler openings 171*a*, 171*b*, 171*c*, 171*d*, 171*g*, and 171*h* are provided corresponding to each of the roller bearings 133*a*, 134*a*, and 139. The oil filler openings 171*a*, 171*c*, and 171*g* are provided at the same locations as those in FIGS. 6 to 9, while the oil filler openings 171*b*, 171*d*, and 171*h* are provided at the locations 180-degree deviated from the oil filler openings 171*a*, 171*c*, and 171*g*, respectively.

According to the sealed-type rotary compressor 100 configured in this way, fresh lubricant can be reliably fed to the portion where the roller bearing is subject to the greatest load, and a highly reliable compressor can be provided.

Needless to say, the present invention is not be limited to the above-mentioned embodiments and various changes and modifications may be made in the invention without departing from the spirit and scope thereof.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sealed-type rotary compressor comprising:

a sealed casing which stores lubricant on the bottom thereof;

an electric motor unit which is housed in the sealed casing;

a compression mechanism which is housed in the sealed casing, and has a cylinder that forms a cylinder chamber, a roller that eccentrically rotates in the cylinder chamber, and a vane that makes a reciprocating motion as the roller rotates;

a rotary shaft which is directed in the vertical direction, pivotally supported by a main bearing and a sub-bearing and couples the electric motor unit and the compressor mechanism; and a roller bearing provided between the roller and a crank shaft unit of the rotary shaft, wherein the roller is formed integrally with an outer circumference of the roller bearing;

a first opening which is provided to the rotary shaft along the center axis from one end face thereof to the other end face side and introduces lubricant from the bottom of the sealed casing; and a second opening, one end of which opens to the first opening and the other end of which opens to the outer circumferential surface of the rotary shaft and opens towards a direction of 30 degrees to 150 degrees from the vane when the crank shaft unit is located with the eccentric direction being located 180 degrees from the vane, and which feeds lubricant to the roller bearing;

wherein the second opening opens on the upper side of the roller bearing.

2. The sealed-type rotary compressor according to claim 1, wherein a second and/or a third roller bearing is provided between the main bearing and the rotary shaft and/or between the sub-bearing and the rotary shaft.

3. The sealed-type rotary compressor according to claim 1, wherein the compression mechanism includes a second assembly of a second cylinder, a second roller, and a second vane provided along the axial direction of the rotary shaft, and the eccentric direction of the crank shaft unit deviates 180 degrees between the first mentioned roller and the second roller.

4. A refrigerating cycle device comprising:

a sealed-type rotary compressor, a condenser, an expansion device, and an evaporator, wherein the sealed-type rotary compressor comprises:

a sealed casing which stores lubricant on the bottom thereof an electric motor unit which is housed in the sealed casing;

a compression mechanism which is housed in the sealed casing, and has a cylinder that forms a cylinder chamber, a roller that eccentrically rotates in the cylinder chamber, and a vane that makes a reciprocating motion as the roller rotates;

a rotary shaft which is directed in the vertical direction, pivotally supported by a main bearing and a sub-bearing and couples the electric motor unit and the compressor mechanism; and a roller bearing provided between the roller and a crank shaft unit of the rotary shaft wherein the roller is formed integrally with an outer circumference of the roller bearing;

a first opening which is provided to the rotary shaft along the center axis from one end face thereof to the other end face side and introduces lubricant from the bottom of the sealed casing; and a second opening, one end of which opens to the first opening and the other end of which opens to the outer circumferential surface of the rotary shaft and opens towards a direction of 30 degrees to 150 degrees from the vane when the crank shaft unit is located with the eccentric direction being located 180 degrees from the vane, and which feeds lubricant to the roller bearing;

wherein the second opening opens on the upper side of the roller bearing.

5. The refrigerating cycle device according to claim 4, wherein a second and/or a third roller bearing is provided between the main bearing and the rotary shaft and/or between the sub-bearing and the rotary shaft.

6. The refrigerating cycle device according to claim 4, wherein the compression mechanism includes a second assembly of a second cylinder, a second roller, and a second vane provided along the axial direction of the rotary shaft, and the eccentric direction of the crank shaft unit deviates 180 degrees between the first mentioned roller and the second roller.

* * * * *